US008435065B2

(12) United States Patent
Littek et al.

(10) Patent No.: US 8,435,065 B2
(45) Date of Patent: May 7, 2013

(54) PLUG-IN UNIT

(75) Inventors: Martin Littek, Korb (DE); Andreas Michael Schremmer, Berglen (DE); Bernd Hagmann, Bad Ueberkingen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 74 days.

(21) Appl. No.: 13/225,220

(22) Filed: Sep. 2, 2011

(65) Prior Publication Data

US 2012/0058685 A1 Mar. 8, 2012

(30) Foreign Application Priority Data

Sep. 7, 2010 (DE) ..... 10 2010 045 470

(51) Int. Cl.
*H01R 13/58* (2006.01)

(52) U.S. Cl.
USPC ..... 439/446; 439/173

(58) Field of Classification Search ..... 439/446, 439/170, 171, 173
See application file for complete search history.

(56) References Cited

U.S. PATENT DOCUMENTS

| | | | | |
|---|---|---|---|---|
| 4,629,276 | A | 12/1986 | Genaro et al. | |
| 5,499,932 | A * | 3/1996 | Tanaka et al. | 439/446 |
| 5,924,880 | A | 7/1999 | Watanabe et al. | |
| 6,338,645 | B1 | 1/2002 | Tan et al. | |
| 7,131,858 | B1 * | 11/2006 | Zerebilov | 439/446 |
| 7,611,365 | B1 | 11/2009 | Ng et al. | |
| 8,313,340 | B2 * | 11/2012 | Krueger et al. | 439/446 |
| 2005/0059287 | A1 | 3/2005 | McHugh et al. | |
| 2008/0261428 | A1 * | 10/2008 | Brodeur | 439/246 |

FOREIGN PATENT DOCUMENTS

| | | | |
|---|---|---|---|
| DE | 20 2008 008 809 | U1 | 10/2009 |
| EP | 0 501 502 | A2 | 9/1992 |

* cited by examiner

*Primary Examiner* — Hien Vu
(74) *Attorney, Agent, or Firm* — Leon D. Rosen

(57) ABSTRACT

A plug-in unit (112, FIG. 7A) with a housing (150) that receives an electrical contact arrangement (55, FIG. 6) that has a cable bushing (151, FIG. 7A). The housing has an aperture (153) in a housing wall for the plugged-in reception of the mating plug-in unit (11, FIG. 2). In order to allow for the optional design of an angled or a linear plug-in connection, the cuboid housing (150, FIG. 7A) is divided along a plane (180) that runs perpendicular to a longitudinal central plane (179) and at a 45° angle to the longitudinal extension of a bushing (151) in such a way that a first housing part (181) contains the cable bushing (151) and the second housing part (182) forms the plug-in aperture (153). The second housing part (182) is attached to the first housing part so the second housing part (182) can be turned with respect to the first housing part (181).

5 Claims, 7 Drawing Sheets

PLUG-IN UNIT

CROSS-REFERENCE TO RELATED APPLICATION

Applicant claims priority from German patent application no. 10 2010 045 470.2 filed Sep. 7, 2010.

BACKGROUND OF THE INVENTION

The present invention relates to a plug-in unit.

Plug-in units of the present type are designed so the reception of a mating plug-in unit runs either perpendicular or in a straight line with respect to the cable bushing of the plug-in unit. This brings with it significant expense not only in design but also in construction since each type of plug-in unit must be designed and manufactured separately.

The objective of the present invention is to provide a plug-in unit of the aforementioned type, which in a simple manner can be used both for an angled as well as for a linear plug-in connector unit that is made up of a first plug-in unit and a mating plug-in unit.

SUMMARY OF THE INVENTION

The housing of the plug-in unit, which is divided at a 45° angle thereby creating two housing parts, allows manufacture of both an angled and a linear plug-in unit. This allows the mating plug-in unit to be joined in plug-in fashion to a first plug-in unit either at a right angle or as a linear extension with respect to the cable bushing. For this purpose, it is only necessary to turn either one of the two housing parts around with respect to the other one.

A blade contact is turned towards the aperture that receives the mating plug-in unit either with one of its longitudinal edges adjoining the cable bushing, or with its transverse edge facing away from the bushing. In this way, the blade contact can always maintain an identical position within one housing part.

The invention provides an additional means of fixing the blade contact and its contact protection in place within the first housing part. The invention provides guidance for the joining process when the two housing parts are joined together.

A locking device can be provided which creates an active plug-in connection between the first plug-in unit and the mating plug-in unit.

The plug-in unit is preferably configured as a single-pole device, but it instead may be a multi-pole device.

Further details of the invention may be derived from the following description, in which the invention is described and explained in greater detail on the basis of the exemplary embodiments that are depicted in the drawing.

DESCRIPTION OF THE INVENTION

Figure 1:
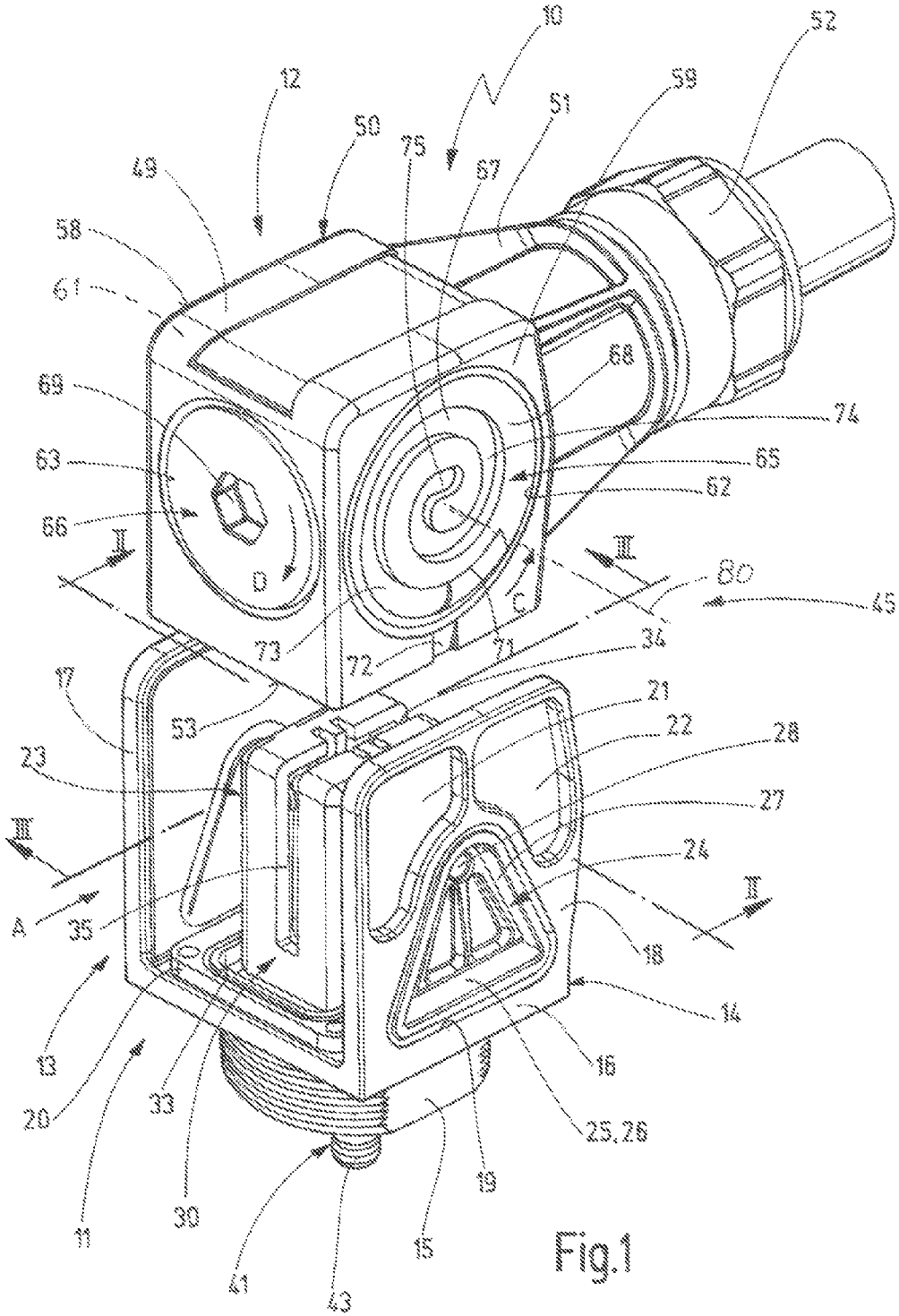
FIG. 1 is an isometric view of a first (female) plug-in unit (11) as well as a second (male) plug-in unit (12) of the plug-in connector device according to one embodiment of the present invention.

Electrical plug-in connector device 10, 110, 210, as depicted in the drawings in accordance with several embodiments, is designed especially for plug-in connections of high transmission power, i.e., high specific power density, as is the case in electrically operated motor vehicles, for example.

Figure 2:
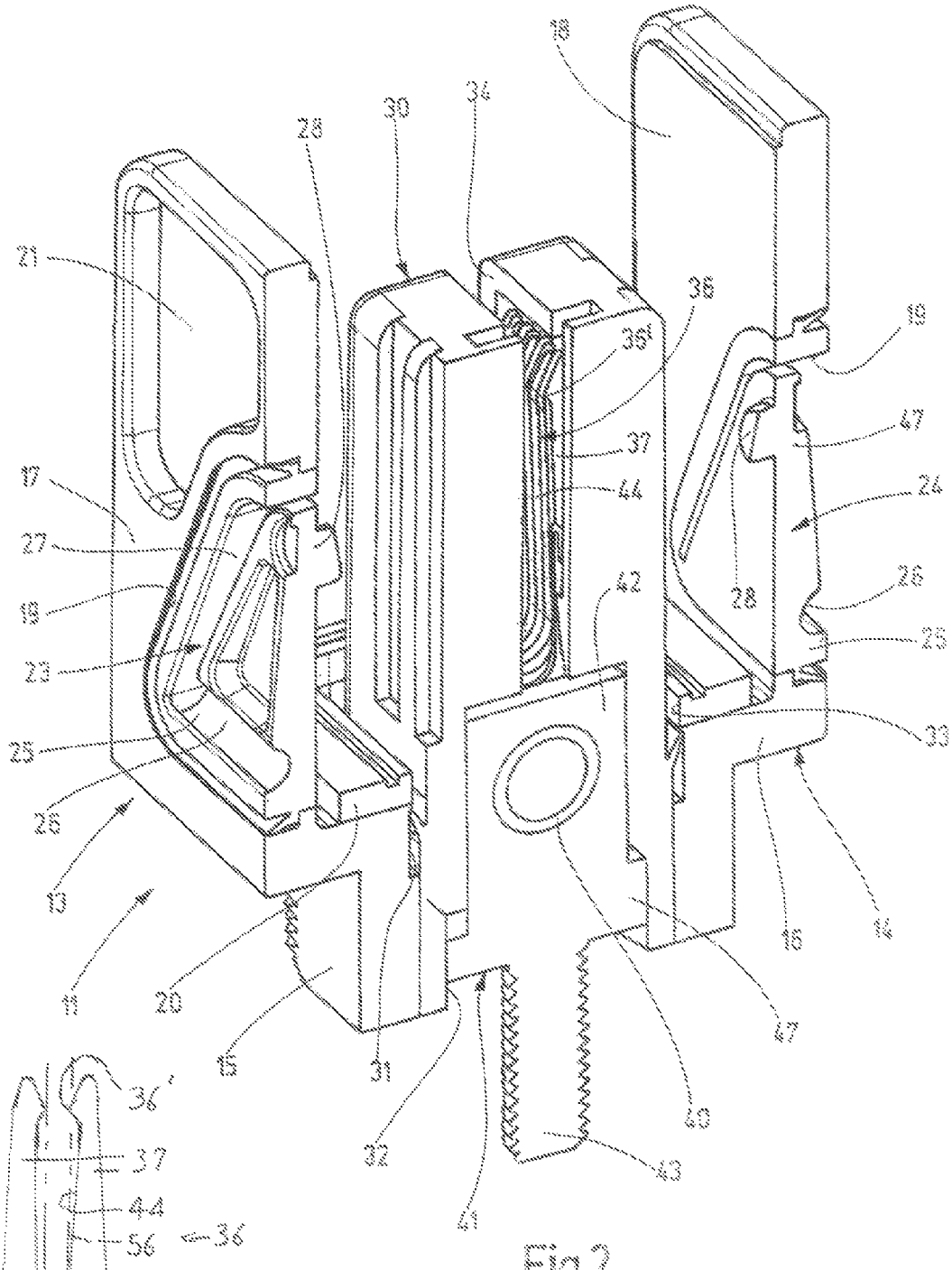
FIG. 2 is a cutaway isometric view along the line II-II of the first plug-in unit shown in FIG. 1.
Figure 3:
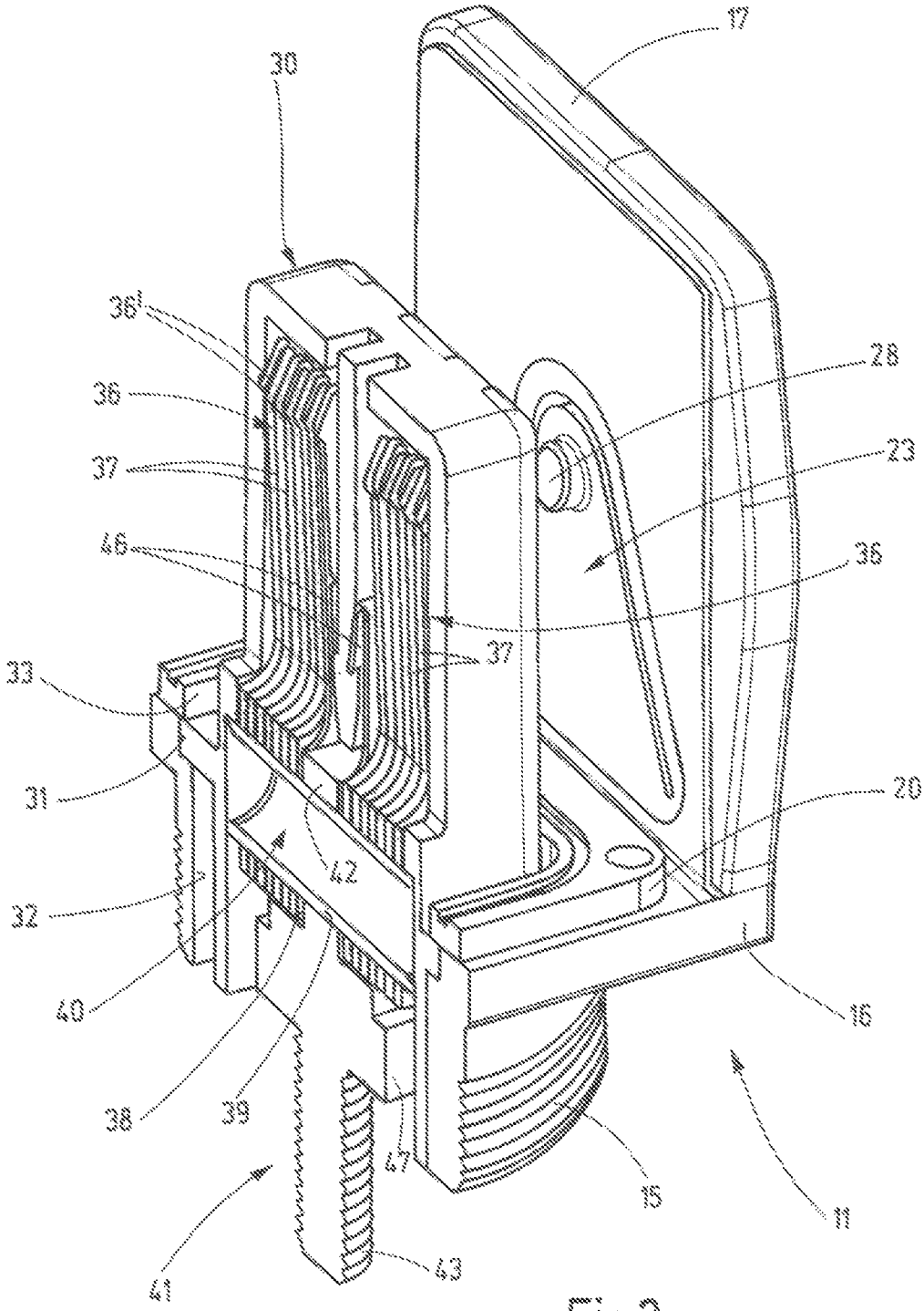
FIG. 3 is a cutaway view along the line III-III of the first plug-in unit shown in FIG. 1.
Figure 4:
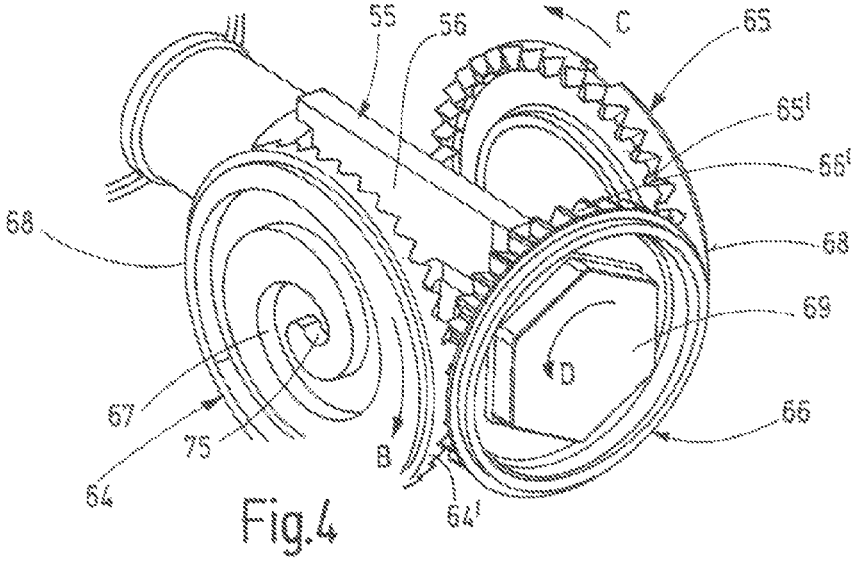
FIG. 4 is an isometric and cutaway representation of the second plug-in unit showing the drive mechanism for a force-fitting plug-in connection of the two plug-in units.
Figure 6:
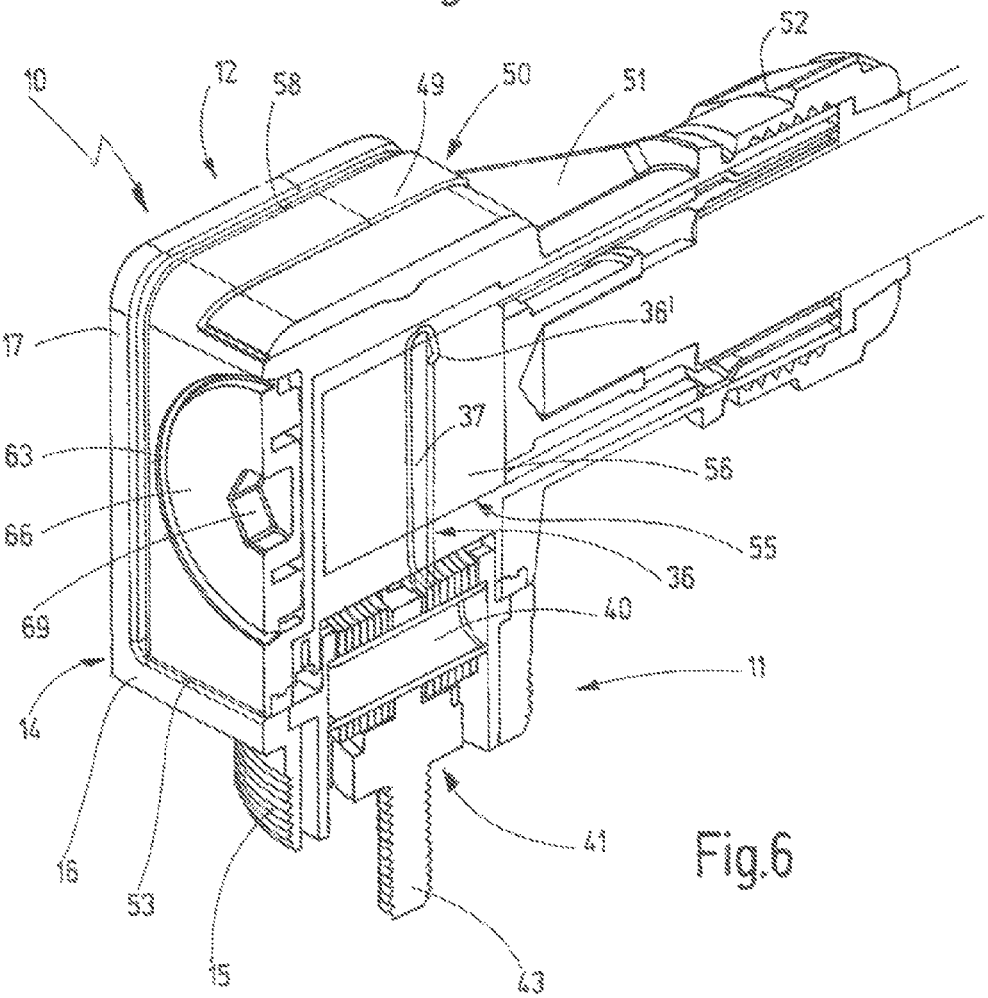
FIG. 6 is a sectional isometric view taken on line VI-VI in FIG. 5, but in a completely plugged-together state of the first and second plug-in units.
Figure 5:
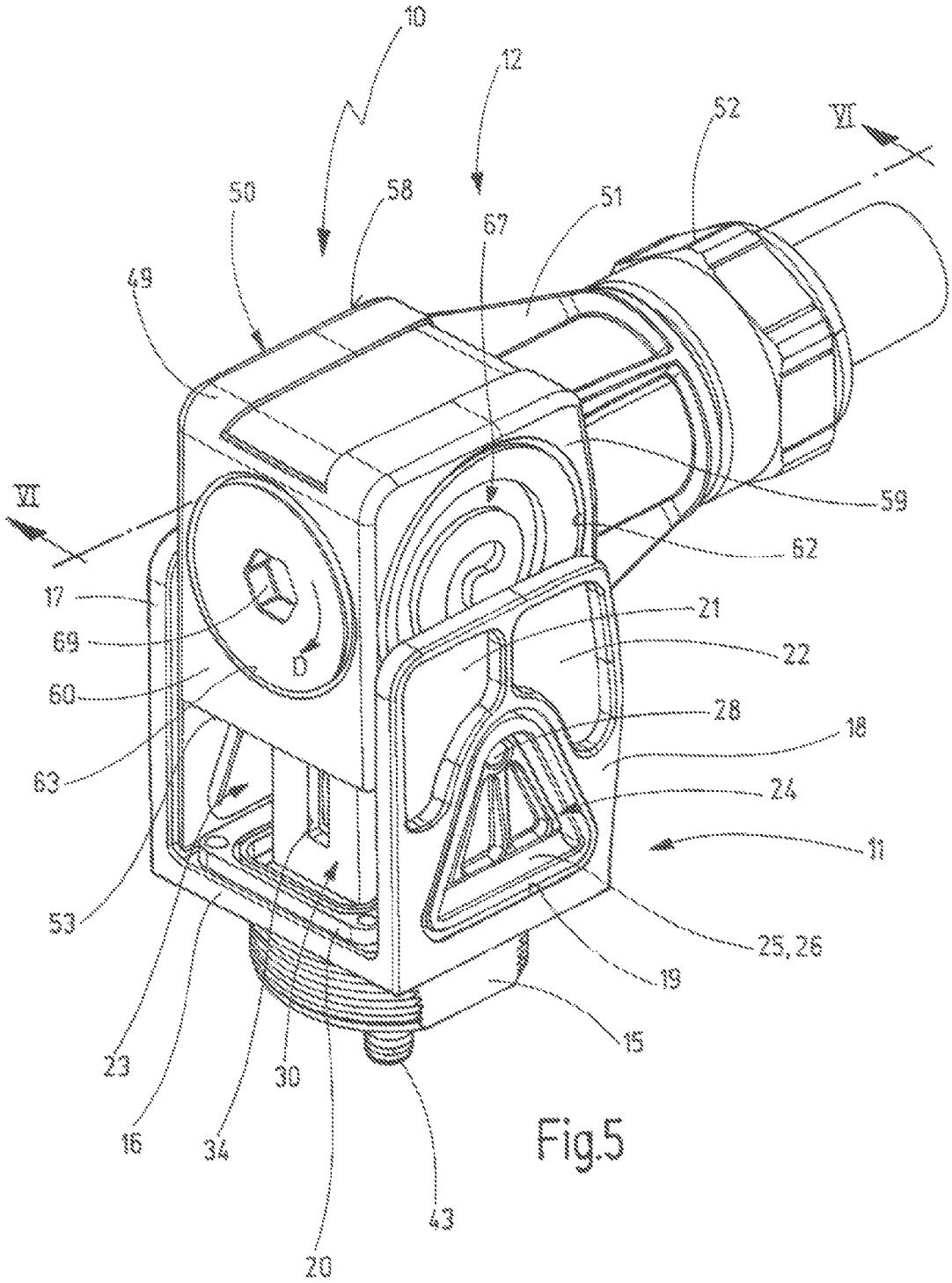
FIG. 5 is an isometric view that depicts a pre-connection step in the electrically conductive plug-in process of connecting the first and second plug-in units of the plug-in connector device in accordance with the invention depicted in FIG. 1.

FIGS. 1, 2, and 3 show a first (female) plug-in unit 11, which can be used both in a plug-in connector device 10 according to FIGS. 1, 5, and 6, as well as in a plug-in connector device 110 according to FIGS. 7 and 8, along with a second (male) plug-in unit 12 (FIGS. 1 and 4) and 112 (FIGS. 7 and 8).

First plug-in unit 11 has an open housing 13 that is made of any material, said housing being made of an electrically conductive material or being provided with an electrically conductive layer in the event an electromagnetic shielding is part of the design, whereby housing body 14 when seen in a front view A has a U-shaped configuration and is integrally provided with an external threaded projection 15 for through-hole mounting on a fixed component. Housing body 14 has a base 16, on each of whose two opposite longitudinal sides an identical, vertically protruding wall part 17, 18 protrudes as an integral part. Both parallel wall parts 17, 18 face base 16 and are furnished with a through-opening 19 that is trapezoidal or triangular in shape and, above said through-opening 19, with recesses 21, 22 that proceed from the exterior side. Facing away from both wall parts 17, 18, base 16 on its lower side is provided with integral external threaded projection 15.

A latching element 23, 24, made of plastic, for example, and having the shape of through-opening 19, is introduced into a through-opening 19. Base area 25 of each latching element 23, 24 is held in latching fashion within through-opening 19 and is weakened in its thickness by a hollow groove 26, forming a film-like hinge, so that triangular area 27 above base area 25 is supported in such a way that it can be deflected in an elastically resilient manner. In the apex area of each latching element 23, 24, a latching cam 28 is molded so as to point to the interior of housing body 14.

Within housing body 14, an electrical insulating-material body 30 is arranged, which accommodates a female contact arrangement 35, is made of electrically conductive material, and is positioned over an essentially longitudinal area of both wall parts 17, 18 of housing body 14, being centrally located between the latter, so that it penetrates cutouts 31, 32, and 33 that are located in base 16, external threaded projection 15, and a rubber seal 20 that contacts base 16. With its end facing away from wall parts 17, 18, said electrical insulating-material body essentially terminates in alignment with the annular end of external threaded projection 15. Insulating-material body 30 may be slid between wall parts 17, 18 through cutouts 31 to 33 and may be held between external threaded projection 15 and seal 20 in latching fashion.

Figure 2A:
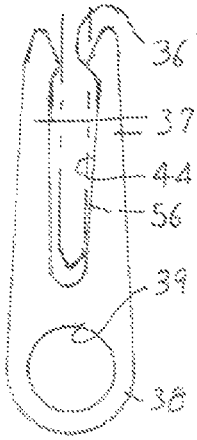
FIG. 2A is an elevation view of one of the spring contacts of FIG. 2.

Female contact arrangement 35 (FIG. 1), employed in the exemplary embodiment depicted, is made up of two packets that are arranged next to each other with spacing and are made up of multiple metal spring contacts 36 (FIG. 2). Spring contacts 36, which in the exemplary embodiment are configured so as to be identically cut from flat metal plate, each have two parallel, elastically deflectable legs 37 (FIG. 2A), which have a U-shape, form a receiving slot 44 between them, and are supported on a base 38, which is provided with a through borehole 39. By means of through boreholes 39, spring contacts 36, which are arranged next to each other and are individually provided with contact points 36', are lined up on a tubular metal carrier 40 and are attached by being strung in packets so as to be in close contact with each other. One end of a holder 41, whose other end 43 is configured as an external threaded pin, is fixedly supported on tubular carrier 40 in the center between the two packets of spring contacts 36. An annular collar 47, by which contact arrangement 35 (FIG. 1) is guided within the lower area of insulating-material body 30, is integrally provided between both ends 42, 43 (FIG. 2). A locking hook 46, which facilitates the locking of contact arrangement 35 within insulating material body 30, is attached between the two adjacent packets of spring contacts 36 on tubular carrier 40.

FIGS. 1 and 4 to 6 show the second (male) plug-in unit 12 according to one preferred embodiment, having a roughly cuboid housing 50, which is provided with a plug-in aperture 53 (FIG. 6) on a side wall or end wall for accommodating first (female) plug-in unit 11. On a second end face, housing 50 is furnished with a bushing 51 and a cable strain relief device 52, in the form of a screw connection, for example, for accommodating a connecting unit of a second (male) electrical contact arrangement 55, which can be, or has been, connected to the stripped cable end, and which is configured in the form of a blade contact 56 (FIG. 6) in the exemplary embodiment.

Housing 50 (FIG. 6) has a hollow body 49 that can be made of any material, said housing being made of an electrically conductive material or being provided with an electrically conductive layer in the event an electromagnetic shielding is part of the design. The housing body 49, if it is made of electrically conductive material, is lined with an insulating material that is not represented in detail. The body has cutouts 61, 62, 63 (FIG. 1), on two opposite longitudinal side walls 58, 59 and on an end wall 60 (FIG. 5), connecting both longitudinal side walls 58, 59, into which a gear wheel 64, 65, 66 (FIG. 4) is inserted so that it can rotate. Cutouts 61, 62, 63 are advantageously configured as bearing shells that are incorporated into the relevant wall. In the exemplary embodiment, gear wheels 64 to 66 are configured as crown wheels having toothed rims 64', 65', 66' that point to the interior of housing body 49. Both opposite, parallel-arranged gear wheels 64, 65, which can also be designated as output drive gear wheels, have a toothed rim of a greater diameter than input drive gear wheel 66, which is arranged on the end face side and whose toothed rim engages both with one gear wheel 64 and with gear wheel 65, so that both, identical output drive gear wheels 64, 65 rotate in opposite directions in accordance with arrows B and C, provided that input drive gear wheel 66 is moved in direction D (or vice versa). In this way, gear wheels 64 to 66 constitute a reduction gear.

Input drive gear wheel 66, which can move in the axial direction, has on its exterior side a tool receptacle 69, by means of which input drive gear wheel 66 may advantageously be rotated using a special tool (e.g. a wrench) in one direction (arrow D) or the other (opposite arrow D). Both output drive gear wheels 64, 65, on their disk surface 68 facing outside have a curved cam track 67 of identical configuration. Curved track 67 facilitates the reception of latching cam 28 (FIG. 2) of latching element 23, 24 in housing body 14 of first (female) plug-in unit 11, as will be described below on the basis of FIGS. 1, 5, and 6. Curved track 67 has an access area 71, which in an initial rotational position of gear wheel 64, 65 is aligned with a groove 72 that emerges from a longitudinal edge of side wall 58, 59. Adjacent to said access area is an area 73 having a relatively gentle slope and beyond that an area 74 having a somewhat steeper slope. Curved track 67 terminates in a linear area 75 which functions as a limit stop. In this way, gear wheels 64, 65 serve a double function.

As can be seen from the preceding design explanations with regard to both plug-in units 11, 12, plug-in units 11, 12 may be joined to form plug-in connector device 10 by being brought into and over each other, whereby the joining together and the force-fitting holding together are accomplished by a locking device 45. The locking device 45 is constituted by interpenetrating components 23, 24, 28, and 64, 65, 67 on first plug-in unit 11 and second plug-in unit 12, respectively.

Proceeding from FIG. 1, in which the initial state is depicted for the plug-in connecting process of both plug-in units 11 and 12, in a first step according to FIG. 5, by way of example, with a first (female) plug-in unit 11 being fixedly held, second (male) plug-in unit 12 is brought with the open side 53 of housing body 50 between the former's two wall parts 17, 18 and over insulating-material body 30. In this context, said two longitudinal side walls 58, 59, which are furnished with gear wheels 64, 65, are inserted into the spaces between insulating-material body 30 and respective wall part 17, 18 in such a way that both latching cams 28 (FIG. 2) within wall parts 17, 18 move via side-wall groove 72 (FIG. 1) into adjacent linear access area 71 of curved track 67, which has been placed in the appropriate position. In this context, latching cams 28 (FIG. 2) contact the base of curved track 67 and are elastically pre-stressed. In this preparatory plug-in state, depicted in FIG. 5, the front, free ends of spring contacts 36 (FIG. 2) are still positioned within the entry area of housing body 49 and therefore are still not in contact with blade contact 56 (FIG. 6).

To create the electrically conductive connection of the two, i.e., to complete the plug-in process between both plug-in units 11, 12, preferably using a special tool, input drive gear wheel 66 on second (male) plug-in unit 12 is rotated via tool receptacle 69 in corresponding direction D. The result is that, based on the motion-locking guidance of latching cam 28 within curved track 67, a further plug-in motion of second (male) plug-in unit 12 into first (female) plug-in unit 11 is caused, until latching cams 28, which are guided within curved tracks 67, come into contact with linear end 75 of curved track 67. Due to the shape of curved track 67, a kind of bayonet locking projected into the plane is achieved in the corresponding force-fitting, final locking state. In this position, blade contact 56, which penetrates through a slot arrangement 34 (FIG. 2) in insulating-material body 30 into the latter, is completely held between the two packets of spring contacts 36, or on their contact points 36', which are elastically pre-stressed.

In the end state of the plug-in connection, an electromagnetic shielding of the contacting is achieved by a material-based configuration of housing bodies 14, 49 of both plug-in units 11, 12 and of seal 20, which are made of, or employ a layer that is made of, an electrically conductive material.

The plug-in connection is correspondingly disengaged in reverse fashion, i.e., by counter-rotating input drive gear wheel 66 (FIG. 4), which results in disengaging the electrical contact between, electrical blade contact 56 and electrical spring contacts 36 (FIG. 2).

In a second (male) plug-in unit 12 of FIG. 1, there is a right angle between cable bushing 51 and plug-in aperture 53 for the first (female) plug-in unit 11. It is obvious that second (male) plug-in unit 12 may also be configured in linear fashion, so that a plug-in connector device 10 is provided that is in linear alignment instead of being at a right angle.

Figure 7A:
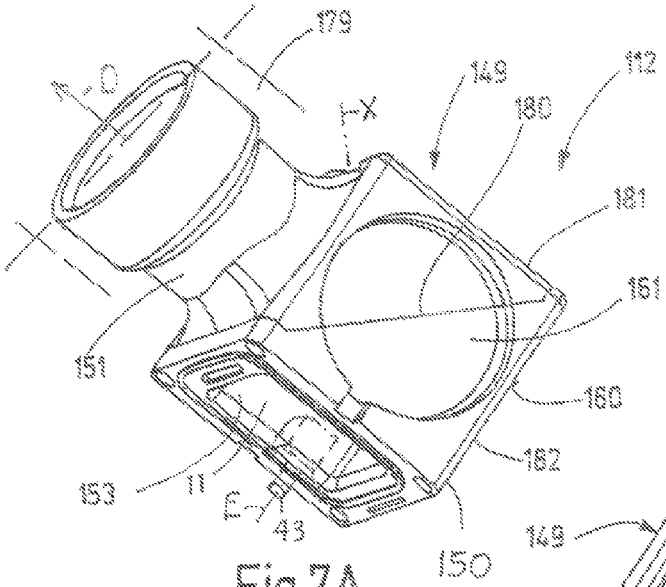
FIGS. 7A and 7B are isometric views that depict two variants of a second embodiment of a second plug-in unit having a two-part housing.
Figure 7B:
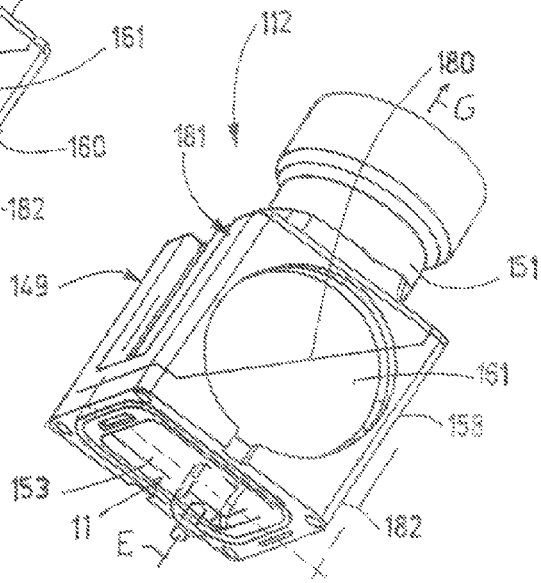

FIGS. 7 and 8 indicate a further (second) embodiment of a (male) plug-in unit 112 with a cuboid housing 150. A cuboid housing is a housing with a majority of its sides lying on a rectangular parallelopiped. The body 149 of cuboid housing 150, which is open on one side, is configured in two parts. The two housing parts 181, 182 are created so they are divided at a 45° angle along a division plane 180. Division plane 180 of housing body 149 is vertical on its central longitudinal plane 179 and runs on a 45° diagonal between two corner edges. Depending on how the housing parts are joined, the direction D of cable-accommodating bushing 151 and the plug-in direction E or G, i.e., the direction of plug-in aperture 153 for first (female) plug-in unit and mating plug-in unit 11, run either perpendicular to each other, as shown in FIG. 7A, or parallel as shown in FIG. 7B.

In FIGS. 7A and 7B the holder end 43 extends along direction E. In other words, the holder end can be attached to a mount that extends along direction E. In FIG. 7A the cable bushing 151 extends along direction D which is angled 90° from E. In FIG. 7B the housing part 181 has been detached from housing part 182 and turned 180° about axis X, so housing part 181 extends along direction G. Axis X is normal to the dividing plane 180. The housing part 181 is then fastened in place. Then the holder end 43 extends along direction E which is in line with bushing direction G.

Figure 8B:
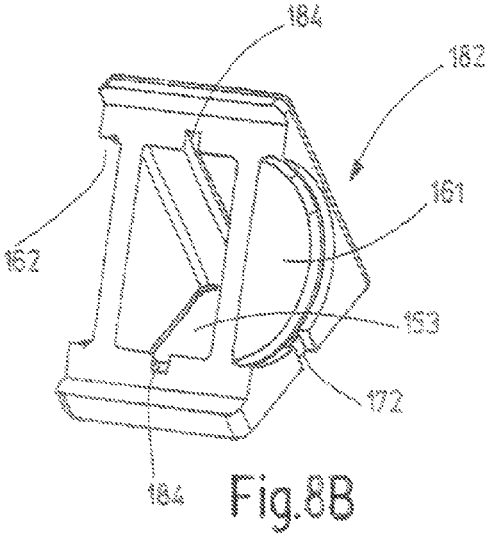
FIGS. 8A and 8B are isometric views that depict one of the two parts of the housing of the second plug-in unit according to the second embodiment.
Figure 8A:
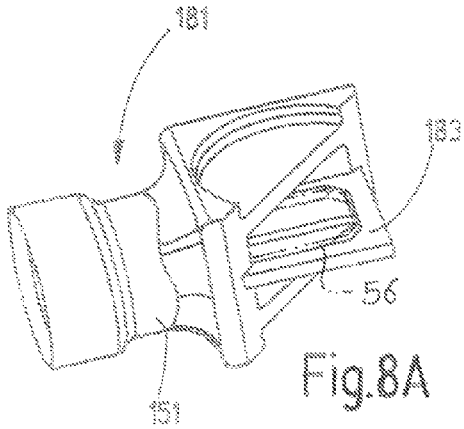

According to FIG. 8A, housing part 181 is provided with bushing 151 and has in its central interior area a frame part 183 as contact protection, within which blade contact 56 (FIG. 2A) is accommodated. Frame part 183 also facilitates the guided accommodation of second housing part 182, which is depicted in FIG. 8B and which has corresponding guide grooves 184 for frame part 183 and plug-in aperture 153. Therefore, rectangular blade contact 56 faces plug-in aperture 153 either with its longitudinal edge (FIG. 7A) or with a free front edge (FIG. 7B).

Cutouts 161, 162 (FIG. 8B) for undepicted gear wheels 64, 65 are indicated accordingly and are shaped in the form of bearing shells. The cutout for the input drive gear wheel is provided either on a front side 160 (FIG. 7A) or on a longitudinal side 158 (FIG. 7B) between cutouts 161, 162.

Figure 9B:
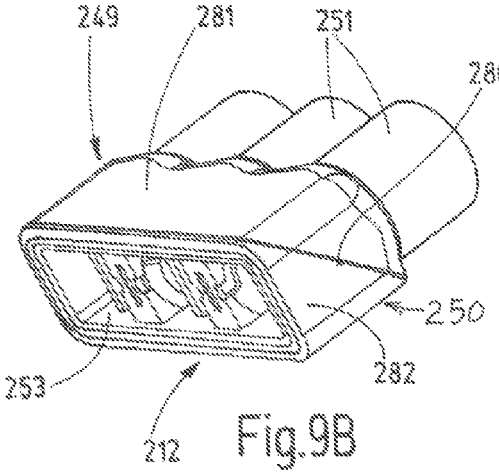
FIGS. 9A and 9B are isometric views that depict two variants of a third embodiment of a second plug-in unit that is similar to FIGS. 7A and 7B, but in a multi-pole embodiment.
Figure 9A:
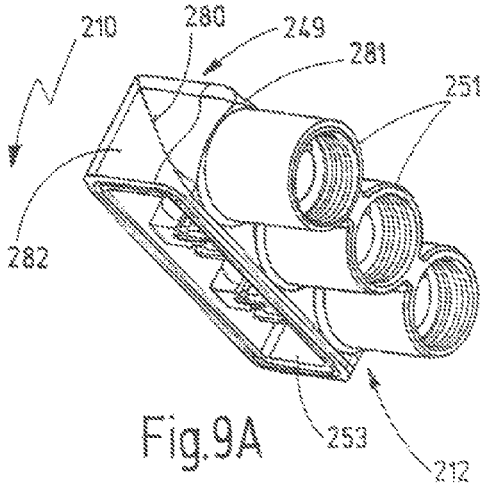
Figure 10A:
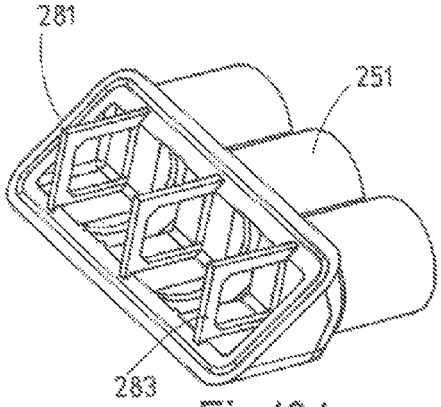
FIGS. 10A and 10B are isometric views that each depicts one of the two parts of the housing of the second plug-in unit according to the third embodiment.
Figure 10B:
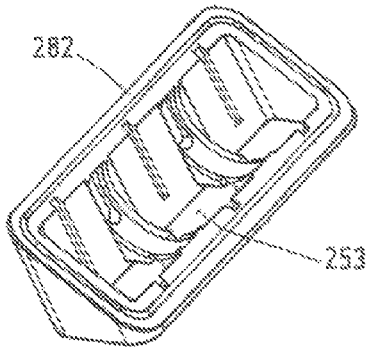

FIGS. 9 and 10 depict a further (third) embodiment of a second (male) plug-in unit 212 for a multi-pole plug-in connector device 210. This multi-pole, second plug-in unit 212 is essentially formed by creating a lateral row of single-pole, second plug-in units 12 (FIG. 1). Multi-pole, second plug-in unit 212 (FIG. 9B), depicted here, is formed by creating a row of multiple (in this example, three) second plug-in units 112 in accordance with FIGS. 7 and 8. In other words, this multi-pole, second plug-in unit 212, as was the case with second plug-in unit 112 which was designed as a single-pole device, is divided in its housing body 249 into two housing parts 281, 282 along division plane 280 at an angle of 45°. The dividing is in such a way that, in accordance with FIGS. 9A and 9B, the choice exists as to whether the direction of cable bushing 251 and the direction of insertion, i.e., the direction of plug-in aperture 253 in a first (female) plug-in unit 211 and a mating plug-in unit (FIG. 11), are arranged perpendicular to each other or in linear fashion (180°).

Figure 11:
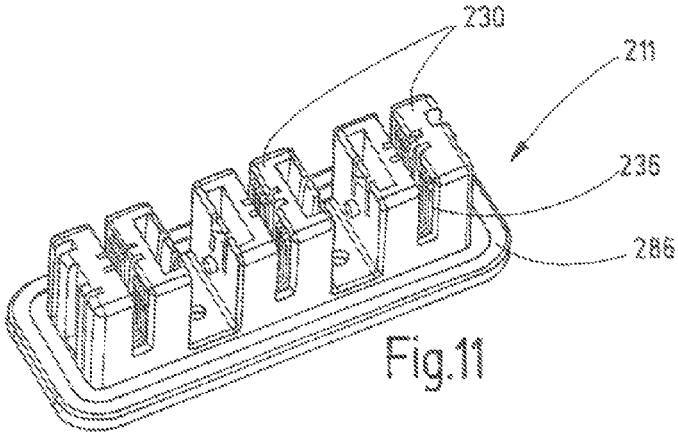
FIG. 11 is an isometric view that depicts a first plug-in unit in a multi-pole embodiment for the electrically conductive plug-in connection with one of the second plug-in units shown in FIGS. 9A and 9B.

FIG. 11 shows a multi-pole, first (female) plug-in unit 211, which is essentially based on multiple first (female) plug-in units 11, preferably on a common base plate 286 without wall parts. Multi-pole, first plug-in unit 211 is the mating plug-in unit for aforementioned multi-pole, second plug-in unit 212.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising:

a first plug-in unit (112, FIG. 7A), having a cuboidal housing (150) for receiving an electrical contact arrangement (55, FIG. 6) of a mating plug-in unit (11, FIG. 7B), wherein the housing has a cable bushing (151) and has a housing wall with an aperture (153) for receiving the mating plug-in unit (11, FIG. 7B);

said housing (150) is divided into first and second housing parts (181,182) along a dividing plane (180) that extends perpendicular to a housing longitudinal central plane (179) and at a 45° angle to sides of said first and second housing parts;

said second housing part (182) forms on aperture (153) for receiving said mating plug-in unit (11), wherein the first housing part (181) can be installed on said second housing part in a first orientation wherein said cable busing (151) extends in a direction D perpendicular to a direction (E) of said mating plug-in unit, and said first housing part can be turned 180° about an axis (X) and installed on said second housing part in a second orientation wherein said cable bushing extends in a direction (G) that is parallel to said mating plug-in unit direction (E);

wherein the electrical contact arrangement (55) has a blade contact (56) which is supported within one housing part (181,281) and that extends beyond said dividing plane (180, 280).

2. The connector described in claim 1, including:

a frame element (183), within which said blade contact (56) is mounted, said frame element lying in said plug-in unit within said first housing part (181, 281).

3. The connector described in claim 2, wherein:

said second housing part (182) has grooves (184) that are arranged to extend perpendicular to each other so as to guide and receive the frame element (183).

4. The connector described in claim 1, wherein:

the two housing parts (181, 182) are joined in a force-fitting manner.

5. A connector comprising:

a housing (150) having first and second housing parts (181, 182) with a cable bushing (151) mounted on said first housing part and extending along a first direction (D)

and with a first plug-in unit (11) mounted on said second housing part (182) and extending in a second direction (E) that is perpendicular to said first direction;

said first and second housing parts are divided along a dividing plane (180) that extends 45° to said first direction (D) and 45° to said second direction (E);

said housing parts can be reconnected to each other with said first housing part (181) turned 180° about an axis (X) that is normal to said dividing plane (180) so said cable bushing extends in a direction (G) that is aligned with said second direction (E);

wherein said first housing part (181, FIG. 8A) includes an internal frame part (183) which has an aperture that holds a blade (56), and said second housing part (182) has a groove (184) that receives said frame part (183).

* * * * *